United States Patent [19]

Wilcox

[11] 3,986,850

[45] Oct. 19, 1976

[54] FLOW CONTROL APPARATUS AND AIR FILTERS

[75] Inventor: David E. Wilcox, Washington, N.C.

[73] Assignee: Flanders Filters, Inc., Washington, N.C.

[22] Filed: Dec. 5, 1974

[21] Appl. No.: 530,007

[52] U.S. Cl. ..... 55/355; 55/385 A; 55/DIG. 29; 55/417; 55/473; 55/484; 98/115 LH; 98/40 D; 98/415 V; 137/246

[51] Int. Cl.[2] ..... B01D 46/00

[58] Field of Search ..... 98/33 R, 33 A, 40 D, 98/40 DL, 40 E, 40 VM, 41 R, 41 AV, 41 SV, 115 LH; 55/DIG. 29, 355, 417, 418, 473, 484, 355, 385 A; 137/246

[56] References Cited

UNITED STATES PATENTS

| | | | |
|---|---|---|---|
| 2,296,081 | 9/1942 | Aspin | 137/246 |
| 2,858,844 | 11/1958 | Gemma | 137/246 |
| 3,001,464 | 9/1961 | Moore | 98/40 D |
| 3,418,915 | 12/1968 | Marble | 98/40 DL |
| 3,486,311 | 12/1969 | Allan, Jr. | 98/40 D |
| 3,522,724 | 8/1970 | Knab | 98/40 D |
| 3,570,385 | 3/1971 | Heisterkamp | 55/473 |
| 3,780,503 | 12/1973 | Smith | 98/40 D |

*Primary Examiner*—Bernard Nozick

*Attorney, Agent, or Firm*—Bell, Seltzer, Park & Gibson

[57] ABSTRACT

A high efficiency air filter system of the type used in clean rooms and the like, and having a sliding plate valve associated with each filter. The sliding plate valve is positioned on the downstream side of each filter, and includes a highly viscous, non-evaporating fluid positioned between the plates to thereby prevent the air from flowing laterally between the plates, whereby the volume of air flow may be accurately controlled over the full area of the clean room as well as the full area of each filter.

12 Claims, 17 Drawing Figures

FLOW CONTROL APPARATUS AND AIR FILTERS

The present invention relates to high efficiency air filters, and more particularly to a sliding plate valve adapted to be employed in association with such air filters to provide a means for selectively and accurately regulating the volume of air flow through the filter.

The need for a controlled, contaminant free work area is well recognized in industry wherever precision manufacturing and assembly operations are conducted, and several clean room designs have been developed for this purpose. In one such present design, the clean room comprises a room-like enclosure having a filter bank suspended from and overlying the entire ceiling. The filter bank includes a number of individual high efficiency filters supported on a rectangular latticework, and a blower introduces air under pressure into the open plenum formed between the filter bank and ceiling. The air then passes downwardly through the filters and vertically through the room. Appropriate ducts are provided in or adjacent the floor for conveying the air back to the blower for recirculation.

In another clean room design, the filter bank is disposed parallel to and spaced from one of the side walls of the enclosure such that the air enters and flows through the room in a horizontal direction. In either case, however, difficulties have been encountered in achieving a laminar and balanced flow through all portions of the filter bank and thus the room. These difficulties result from several factors, including the fact that the open plenum behind the filter bank normally has a varying pressure through its area which is caused by the particular location of the entry line from the blower. Thus those filters immediately adjacent the entry line are subjected to a higher pressure differential, while those filters remote from the entry line are subjected to a somewhat lower pressure differential.

Another factor which causes non-uniform flow through the filters is the fact that the filters employed in the bank may have differing resistances to the air flow resulting, for example, from the use of filter media having slightly different air flow properties in the various filters. Still further, it has been found that the individual filters may have certain areas therein which have a different air resistance from that in other areas of the same filter.

These differences in air resistance are translated into differences in air velocity and volume passing through the several filters in a bank, as well as differences in velocity and volume in the various areas of the individual filters. This non-uniformity of air flow upsets the desired laminar flow pattern through the clean room and causes, turbulence, and thus is unsatisfactory.

In still another clean room design, each filter in the filter bank includes a hood or housing which is sealably secured to the upstream side thereof. Each hood includes a stack communicating with an air supply duct positioned above the bank, and thus the air is delivered directly to the filter rather than into a large open plenum. Also, such hoods commonly include an adjustable volume control damper in the stack of the hood for controlling the volume of air entering the hood from the supply duct. While this volume control damper is helpful in balancing the flow rate between filters, there is no effective way to overcome the flow variations resulting from the differences in air resistance which may exist in various portions of an individual filter.

In an attempt to achieve a more balanced flow through the clean room, it has also been proposed to provide a filter system wherein a number of filter units are mounted in a large plenum chamber, and each filter unit includes a pair of sliding apertured plates mounted on the upstream side thereof and which function as a valve for controlling the air flow into the filter. However, this arrangement has not satisfactorily overcome the problem of non-uniform flow since perfect contact cannot be maintained between the apertured sliding plates of the valve in view of surface irregularities and the fact that the plates are often slightly bent or warped. Thus the valves commonly have areas in which the plates are slightly separated, and this separation permits the air to flow laterally between the plates during use and exit from a non-predictable area. Thus the lateral air flow upsets the desired air distribution, and in some cases makes it impossible to completely close the valve.

The above described sliding plate valve is also unsatisfactory in that it does not overcome the problem of non-uniform flow through different areas of an individual filter. Still further, the air being supplied to the filters may in some cases be corrosive by reason of the presence of acid particles or the like, and the fact that the valve in the above described arrangement is positioned on the upstream side of the filter results in the valve being directly exposed to such corrosive air and thus may result in its deterioration.

It is accordingly an object of the present invention to provide a flow control apparatus for a bank of air filters in a clean room or the like, and wherein the air flow through the bank may be selectively and accurately controlled to achieve a substantially uniform, laminar flow through all areas of the clean room.

It is another object of the present invention to provide a flow control apparatus for an individual air filter and wherein the air flow may be controlled to achieve a uniform flow from all areas of the filter.

It is a more particular object of the present invention to provide an air flow control valve comprising a pair of relatively slidable apertured plates and which has provision for precluding the flow of air laterally between the plates during use, and provisions for substantially adhering the plates together to prevent inadherent relative movement therebetween.

It is another particular object of the present invention to provide an air flow control valve which is adapted to create a pressurized plenum immediately downstream of the filter media to thereby uniformly distribute the air flowing from the entire area of the filter.

It is still another object of the present invention to provide a flow control valve for a bank of air filters and which is readily accessible from the downstream side of the filters.

It is also an object of the present invention to provide a flow control valve for an air filter and which is positioned downstream of the filter to thereby avoid contamination from any corrosive particles which are removed from the air supply by the filter.

These and other objects and advantages of the present invention are achieved in the embodiments illustrated herein by the provision of an air filter having a valve transversely overlying the air flow opening of the filter and comprising first and second substantially flat plates each having myriad regularly spaced apertures therethrough, and means for selectively translating one of the plates laterally with respect to the other such that the apertures may be selectively brought into alignment to effect opening of the valve and brought out of alignment to effect closing of the valve. A highly viscous, non-evaporing fluid is interposed between the opposing faces of the two plates to prevent the flow of air laterally therebetween and thus assure that the air flow may be accurately controlled by the relative positioning of the apertures. Also, the two plates of the valve are preferably positioned on the downstream side of the filter so as to define a plenum between the downstream face of the filter pack and the valve. Thus the air flowing through the filter pack initially enters the plenum where a positive pressure is developed and which serves to equalize the velocity and volume of the air flowing outwardly from all portions of the valve and thus the filter.

Some of the objects and advantages of the invention having been stated, others will appear as the description proceeds, when taken in connection with the accompanying drawings, in which FIG. 1 is a sectioned side elevation view of a clean room which embodies the flow control apparatus of the present invention;

Figure 1:
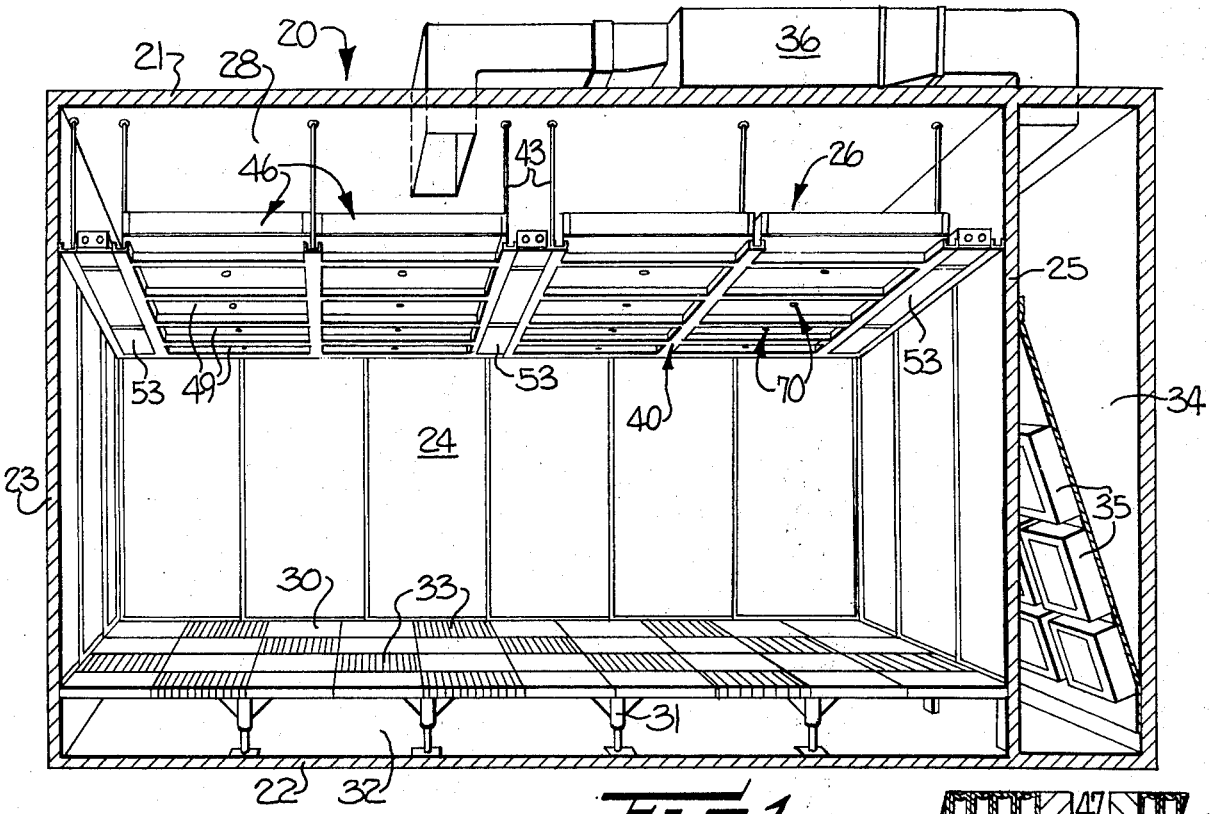
Figure 15:
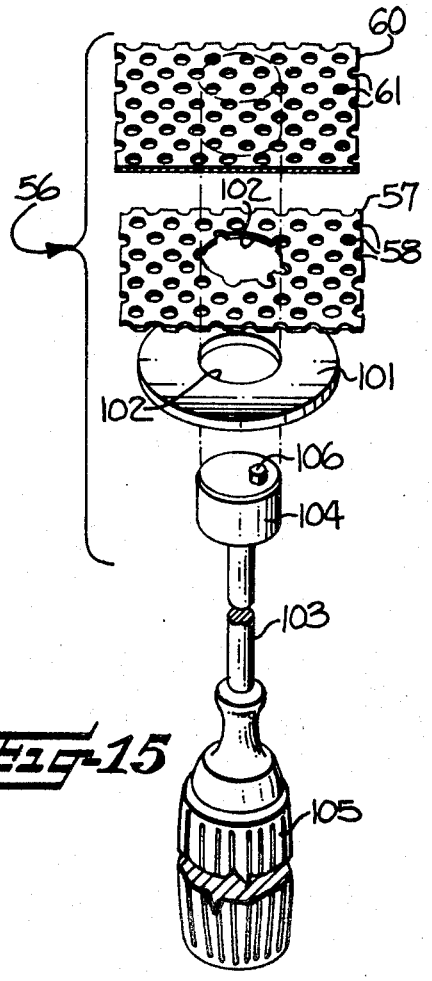
FIG. 15 is an exploded perspective view illustrating another embodiment of a cam control member which is adapted for use with the flow control valve of the present invention.
Figure 16:
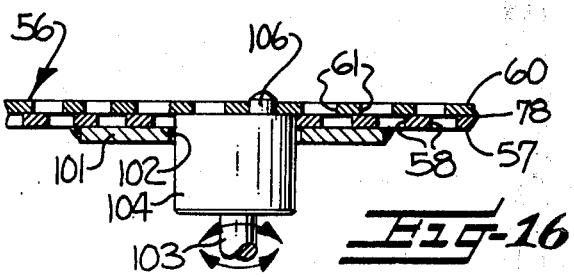
Figure 17:
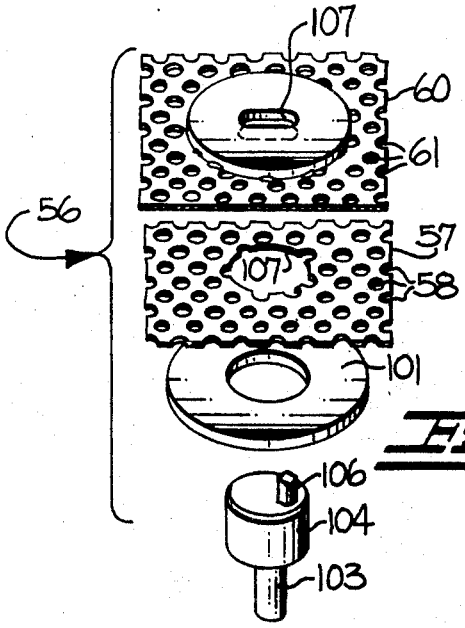

FIG. 16 is a fragmentary side elevation view illustrating the cam control member of FIG. 15 in its operative position; and FIG. 17 is similar to FIG. 15, but illustrates a further embodiment wherein pure linear movement between the plates is desired. Referring more specifically to the drawings, FIG. 1 illustrates a clean room 20 embodying the features of the present invention, the clean room comprising an enclosure which includes a top wall 21, a bottom wall 22, and bounding side walls 23, 24, and 25 (the fourth side wall not being shown). A horizontally disposed filter bank 26 is positioned within the enclosure parallel to and spaced from the top wall 21 to define an open air supply plenum 28 therebetween. A raised floor 30 is mounted on suitable pedestals 31 above the bottom wall 22 to define a return air plenum 32, the floor 30 including a number of perforated panels 33 for permitting air to pass therethrough. The return air plenum 32 communicates with a vertical duct 34 containing a number of pre-filters 35, and the vertical duct in turn communicates with the air handling unit 36 for recirculating the air into the air supply plenum 28. Typically, the air handling unit 36 comprises a blower, and a heating or air conditioning apparatus. Thus in use, the air delivered to the air supply plenum 28 by the air handling unit 36 passes downwardly through the filter bank 26 such that substantially all contaminants are removed immediately before the air enters the room. The air then passes vertically downwardly through the room and through the floor 30 to the return air plenum 32. The returning air passes through the pre-filters 35 where any relatively large particles in the air stream are removed, and through the blower to the air supply plenum 28.

The filter bank 26 has an area substantially coextensive with the area of the top wall 21, and comprises a horizontally disposed supporting latticework 40 composed of a plurality of interconnected U-shaped channels 41 having their open sides directed upwardly. The latticework 40 defines a plurality of rectangular open areas 42, and is suspended from the top wall 21 by means of a plurality of tie rods 43. The channels located about the perimeter of the bank 26 are sealably secured to the adjacent side walls by a mastic selant or the like (not shown) to prevent air leakage therebetween, and a fluid 44 (FIG. 3) is disposed within the open channels 41 for the purposes set forth below.

A plurality of air filters 46 are positioned on the latticework 40 with one of the filters covering each of the open areas 42. Each filter 46 comprises a rectangular frame 47 fabricated from wood, pressed chipboard, or the like, and defining a centrally disposed air flow opening 48. A filter pack 49 is sealably disposed within the air flow opening, and typically comprises a sheet of filtering media folded in accordion fashion and with the folds thereof lying substantially parallel to the direction of air flow through the filter. As well known in the art, the sheet of filtering media may be fabricated from glass, ceramic, or cellulose-asbestos, and may be designed to remove sub-micron size particles from an airstream at extremely high efficiencies. Filters of this type are generally called "absolute" or "HEPA" filters in the industry.

Figure 2:
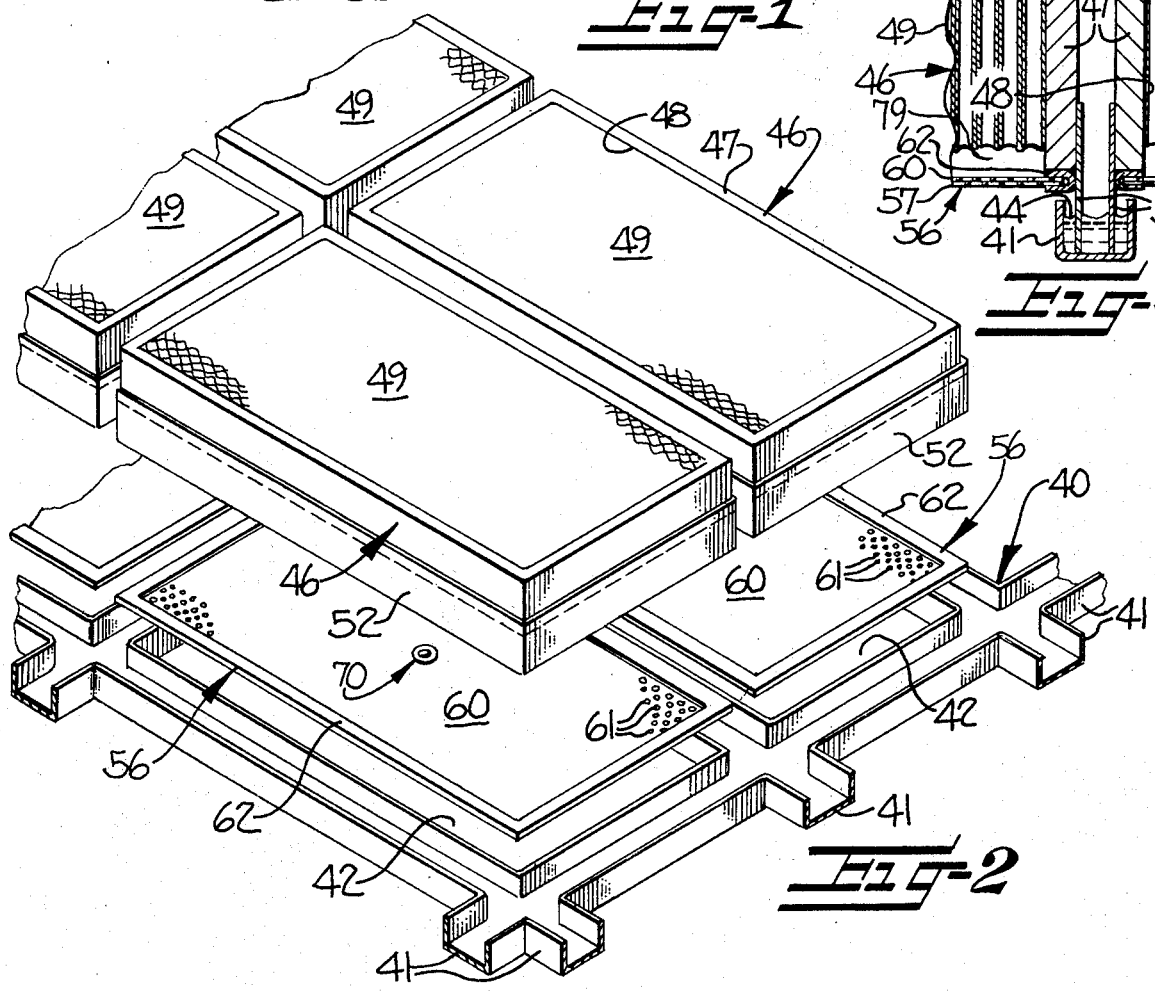
FIG. 2 is an exploded perspective view of the filter bank employed in the clean room shown in FIG. 1.
Figure 3:
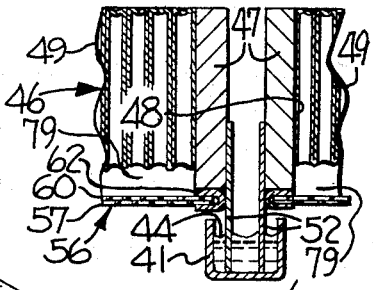
FIG. 3 is a fragmentary side elevation view of the filter bank shown in FIG. 1 and illustrating the means for sealing the filters in the supporting latticework.

In the embodiment of FIGS. 1-3, each filter further comprises a downwardly depending metal skirt 52 positioned about the outer periphery of the frame 47, the skirt being adapted to rest within the open channels 41 and be sealably secured thereto by the fluid 44. Also, a plurality of lighting fixtures 53 may be positioned intermediate certain of the filters and sealably secured on the latticework by means of a depending edge positioned within the open channels. A further description of the above described filter bank and fluid sealing arrangement may be obtained by reference to U.S. Pat. No. 3,486,311 to Allan.

In accordance with the present invention, an independently operable air flow control valve 56 coextensively overlies the downstream side of each of the air filters 46, and is adapted to selectively and accurately regulate the volume of air flowing therethrough. As best seen in FIGS. 8–11, the valve 56 comprises a first or lower substantially flat plate 57, having myraid relatively small, regularly spaced apertures 58 extending therethrough, and with the apertures 58 being positioned to overlie substantially the entire area of the plate. A second or upper substantially flat plate 60 of a size corresponding to that of the first plate overlies the first plate and has myriad apertures 61 extending therethrough which are of a size and spacing corresponding to the size and spacing of the apertures 58 in the first plate. In the illustrated embodiment, the aperures 58 and 61 are circular in cross section, and typically the apertures have a diameter of about ⅛ inch and are spaced about 7/32 inch from center to center. Preferably, the apertures should comprise at least about 30% to 35% of the total area of the plates.

The plates 57 and 60 may be fabricated from any suitable material such as metal or plastic, and they are of rectangular cross-section to define a rectangular peripheral edge portion (not numbered). The plates are maintained in an overlying, face to face relationship by means of a "picture frame" rectangular channel 62 of U-shaped cross-sectional configuration, the channel 62 being adapted to receive the peripheral edge portions of the plates 57 and 60 as seen for example in FIG. 8.

Preferably, the channel 62 is fabricated from a relatively soft, pliable material, such as buta-rubber, but a rigid material such as metal or plastic could be employed. Also, the channel is dimensioned to permit a degree of relative sliding movement between the plates as hereinafter further described. The channel 62 (and thus the entire valve 56) may be adhesively secured to the downstream end of the filter as illustrated at 63 in FIG. 8, but if desired, the channel 62 and valve 56 may be freely separable from the filter to facilitate removal and replacement of the filter 46, note for example the embodiment in FIG. 7 as described below.

Figure 4:
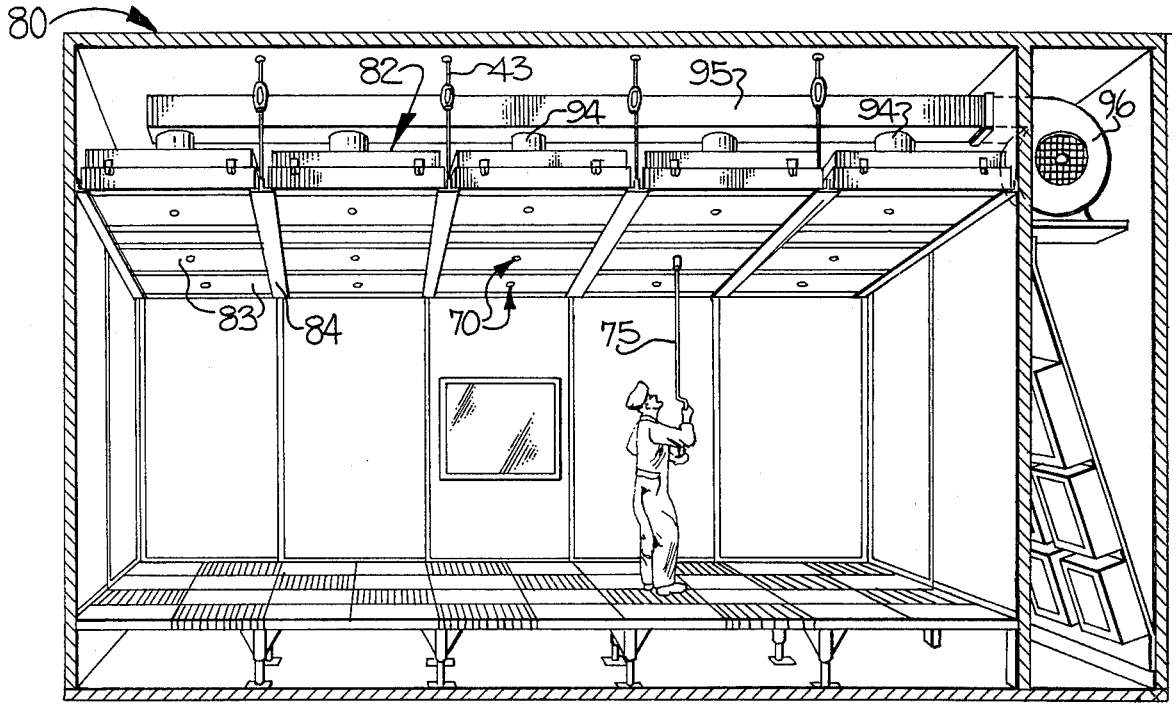
FIG. 4 is a view similar to FIG. 1 and illustrating another embodiment of a clean room which embodies the present invention.
Figure 5:
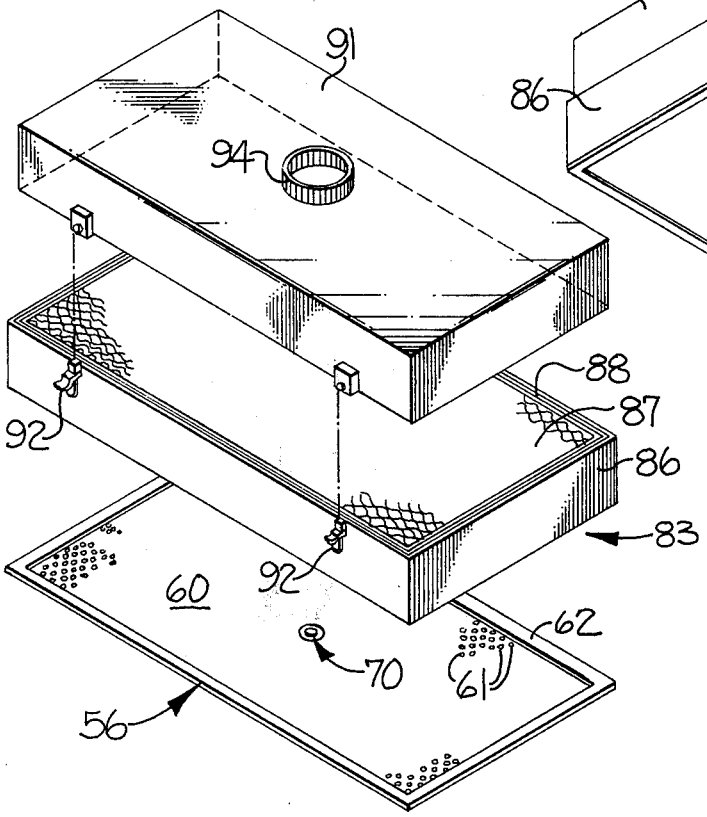
FIG. 5 is an exploded perspective view of a flow control valve and filter as employed in the filter bank shown in FIG. 4.
Figure 6:
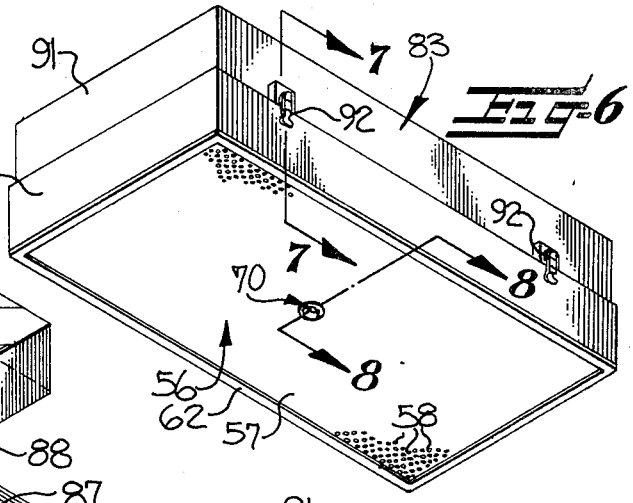
FIG. 6 is a perspective view of a valve and filter as employed in the filter bank of FIG. 4.

The air flow control valve 56 of the present invention further includes means accessible from within the clean room for sliding or translating the plates 57 and 60 laterally with respect to each other to selectively and accurately regulate the volume of air flowing therethrough. More particularly, and as illustrated in the embodiments of FIGS. 8–11, this translating means comprises a first washer 66 secured (as by welding or adhesive) centrally on the bottom surface of the first plate 57, the washer 66 defining a first relatively large opening 67 through the plate. A second washer 68 is secured on the upper surface of the plate 60 and generally above the first washer 66, the second washer 68 defining a relatively small opening 69 therethrough. A cam control member 70 extends through the openings 67 and 69 and is carried by the plates, the cam member including a nut-like lower end 71, and a cylindrical portion 72 closely received within the first opening 67. A stud 73 is threadedly secured to the remaining portion of the cam member and forms an upwardly extending end portion which is closely received within the second opening 69 of the plate 60. The end portion 73 is axially offset from the axis defined by the cylindrical portion 72, whereby rotation of the cam member causes the end portion 73 to act upon the boundary of the second opening 69 and thereby move the plates 57 and 60 laterally with respect to each other. Thus the apertures 58 and 61 in the plates may be selectively brought into alignment to effect opening of the valve (note FIG. 11), or they may be brought out of alignment to effect closing of the valve (note FIG. 10). In addition, they may be brought to an intermediate relative position (not shown) wherein an air flow of reduced volume is permitted to pass therethrough. Such rotation of the cam control member may be conveniently effected by means of a hand tool as shown generally at 75 in FIG. 4 and which is adapted to engage the nut-like lower end 71 of the cam member.

In accordance with one aspect of the present invention, a non-evaporating fluid 78 is interposed between the opposing faces of the plates 57 and 60. The fluid 78 is in the form of a thin film and serves to occupy any space between the plates caused by any surface irregularities or warpage thereof. Suprisingly, it has been found that the presence of the fluid serves to block and prevent the flow of air laterally between the plates and assures that the air moving through an aperture 61 in the top plate 60 comes through the corresponding aperture 58 located directly therebelow, and does not move laterally and then out of some other non-predictable aperture. Thus the air flow through all portions of the overlying plates may be accurately controlled by the relative positioning of the apertures 58 and 61 therein.

Several highly viscous, non-Newtonian fluids, such as household petrolatum, or a silicone grease having a consistency substantially the same as that of household petrolatum, have been found to be very satisfactory for use as the fluid 78 in the present invention. Such fluids may be further characterized as being non-corrosive, semi-solid at room temperature, and subject to easy deformation at room temperature. Preferably, the fluid has a viscosity between at least about 70,000 to 150,000 centipoise as measured at room temperature by a Brookfield viscometer having a No. 2 spindle, and such highly viscous fluids tend to naturally adhere to the plates and thus serve to hold the plates together to prevent inadvertent relative movement as could result, for example, from the vibration generated by the blower in the air handling unit 36.

As a particular example of a suitable fluid 78, a silicone grease manufactured and sold by Dow Chemical Corporation as Product No. 111 is mixed with a small amount of silicone adhesive sold by Dow Chemical Corporation as Product No. 732. The silicone adhesive contains a moisture activated hardening agent as known in the art and which acts to stiffen the mixture somewhat after being exposed to the atmosphere for a period of time. The resulting viscosity of the mixture after the above stiffening process is about 150,000 cps at room temperature.

As noted above, the air flow control valve 56 of the present invention is preferably mounted at the downstream end of the associated filter, and as seen in FIG. 3, such positioning results in the formation of a plenum 79 between the lower face of the filter pack 49 and the valve 56. When in use, the natural air resistance of the valve results in the formation of a positive pressure within the plenum 79, and it has been found that this pressurized plenum serves to compensate for any non-uniformity in the flow through the filter pack, and thus serves to provide a uniform flow on the downstream side of the valve throughout the entire area of the filter.

FIGS. 4–7 illustrate the use of the present invention in a clean room 80 of somewhat different design from that illustrated in FIG. 1. More particularly, the clean room comprises a filter bank 82 composed of a number of individual filters 83 supported on the latticework 84, and with each filter comprising a rectangular frame 86, and a filter pack 87 sealably disposed within the air flow opening of the frame. The upstream end of the frame 86 includes a continuous, fluid filled channel 88. A generally box-like hood 91 encloses the upstream side of the filter 83, and the lower peripheral edge of the hood is dimensioned to enter the channel 88 and become sealably disposed therein in the manner further described in U.S. Pat. No. RE 27,701 to Allan et al. Also, the hood 91 is releasably secured to the filter by means of the latches 92, and each hood includes a stack 94 communicating with an air supply duct 95 positioned above the filter bank. The duct 95 is in turn being operatively connected to the blower 96.

Figure 7:
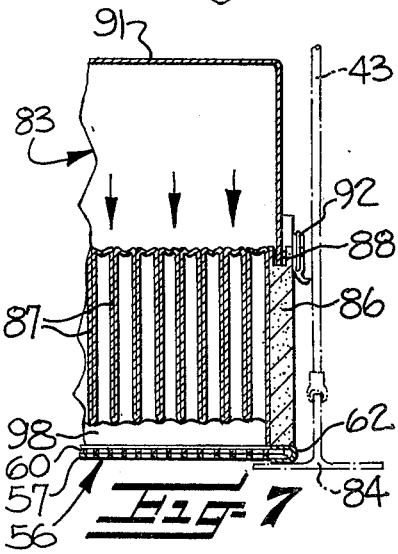
FIG. 7 is a fragmentary sectional view taken substantially along the line 7—7 of FIG. 6 and further illustrating the supporting latticework for the filter bank.
Figure 8:
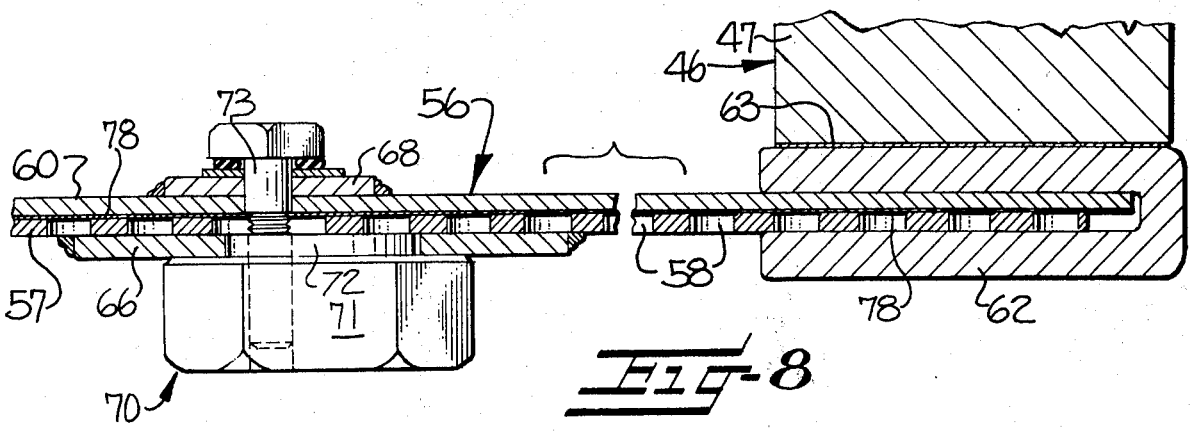
FIG. 8 is a fragmentary, enlarged section view of a flow control valve embodying the present invention and taken substantially along the line 8—8 of FIG. 6.
Figure 9:
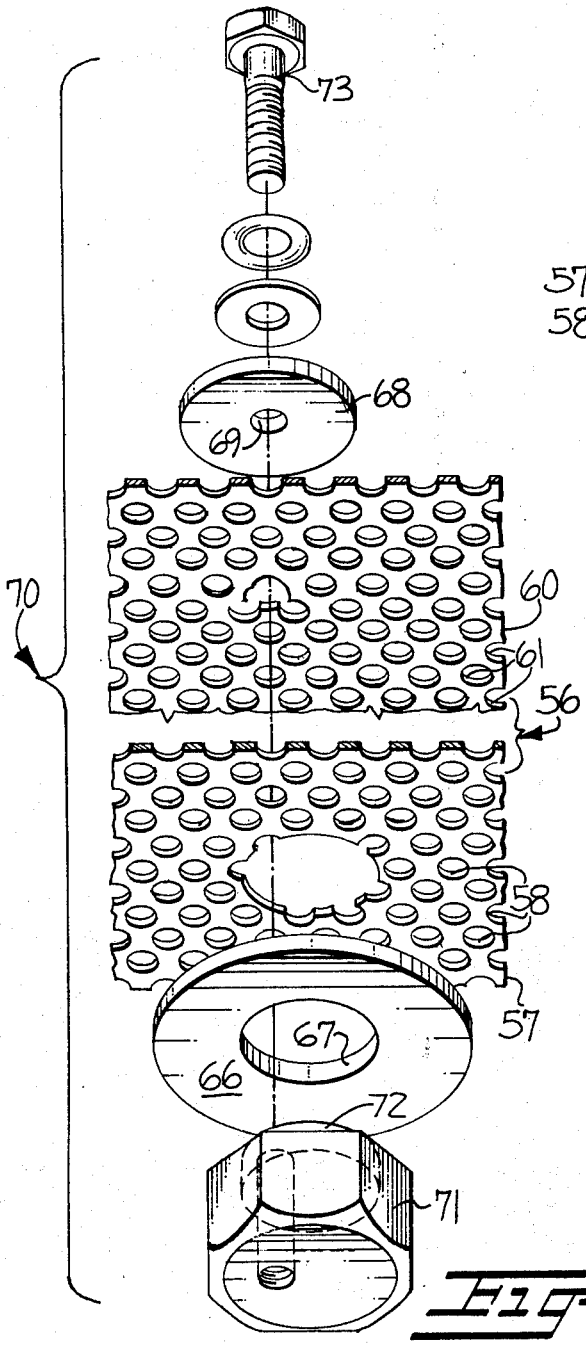
FIG. 9 is an exploded perspective view illustrating the cam control member of the valve shown in FIG. 8.

Each filter 83 in the bank 82 also includes an independently operable air flow control valve 56 as described above, the valve 56 resting between the latticework 84 and downstream end of the frame 86 as best seen in FIG. 7 such that a plenum 98 is formed between the valve and the downstream face of the filter pack. In this embodiment, the valve is unattached to either the latticework or the associated filter to facilitate removal and replacement of the filter.

Figure 10:
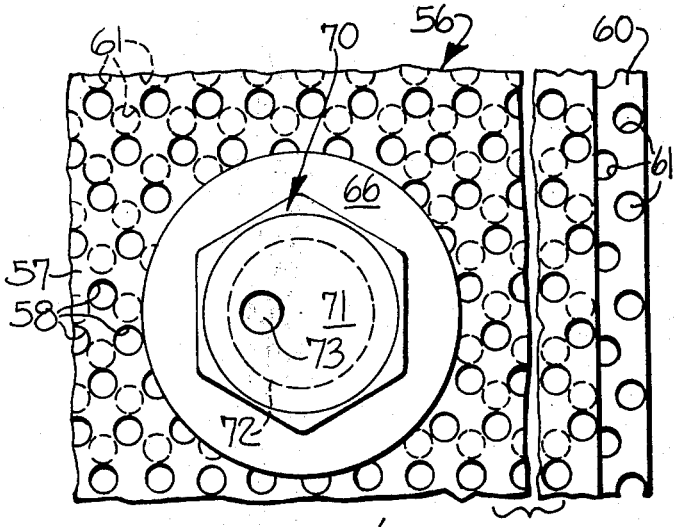
FIG. 10 is a fragmentary bottom plan view of the cam control member and illustrating the valve in its closed position.
Figure 11:
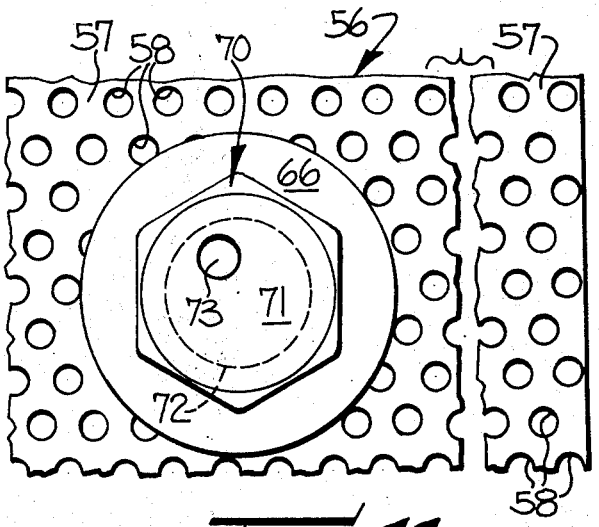
FIG. 11 is a view similar to FIG. 10 and illustrating the valve in its open position.
Figure 12:
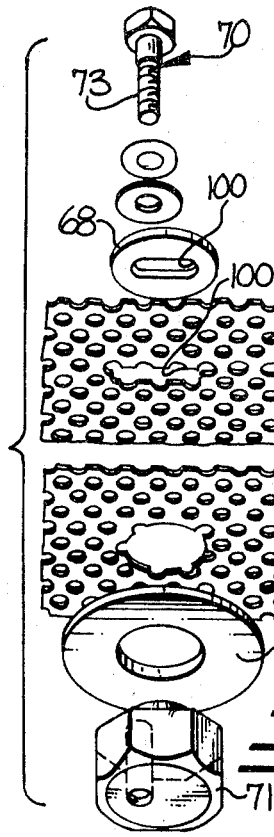
FIG. 12 is an exploded perspective view illustrating a second embodiment of a cam control member for use with the present invention.
Figure 13:
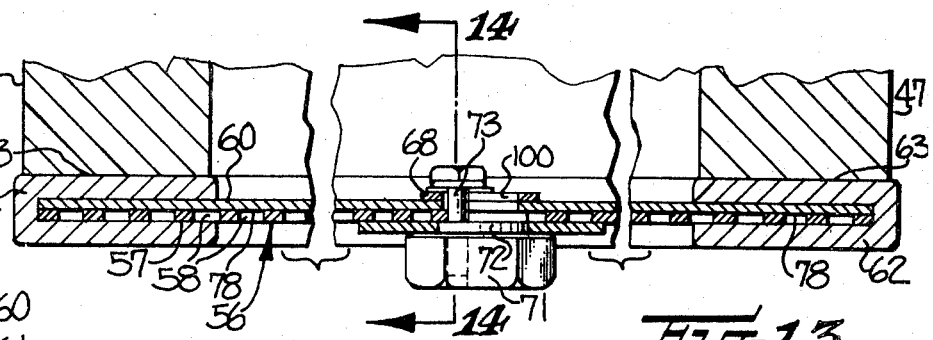
FIG. 13 is a fragmentary section view of a flow control valve embodying the present invention and including the cam control member as shown in FIG. 12.
Figure 14:
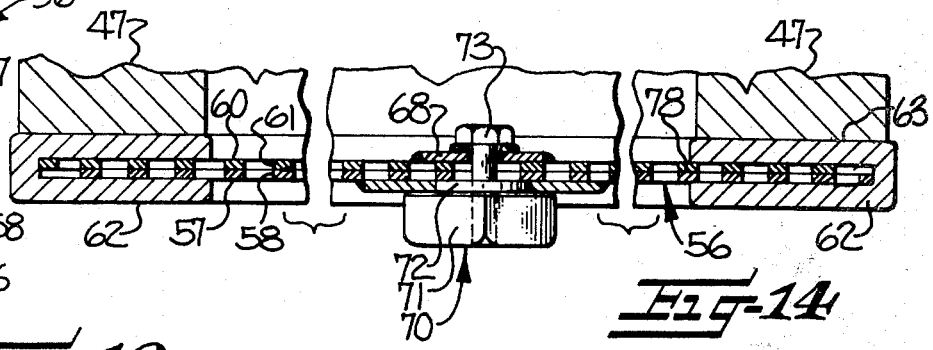
FIG. 14 is a veiw similar to FIG. 13 but taken at right angles thereto and along the line 14—14 in FIG. 13.

As will be apparent from FIGS. 10 and 11, the relative movement of the plates 57 and 60 caused by the rotation of the cam control member 70 is in both a longitudinal and transverse direction. In certain instances, it may be difficult to maintain a uniform relative movement throughout the area of the valve, and in such cases the air control valve 56 may be provided with means for assuring that the relative movement between the plates is along a purely linear path of travel. In this regard, reference is made to FIGS. 12–14, wherein the channel 62 for mounting the plate is dimensioned to permit lateral relative movement along a line extending between the sides shown in FIG. 14, and to preclude lateral movement along a line extending between the sides shown in FIG. 13. Also, the opening formed in the upper plate 60 is in the form of a slot 100 so as to permit the desired linear movement.

FIGS. 15 and 16 illustrate a simplified structure for relatively translating the plates. As shown, the structure comprises a washer 101 defining a first relatively large opening 102 in the first plate 57, and a separate manually grippable cam control member 103 which includes a cylindrical end portion 104 adapted to be closely received within the opening 102, and a handle 105. An upwardly extending stud 106 is secured to the upper surface of the cylindrical portion 104, the stud 106 being axially offset within one of the apertures 61 in the upper plate 60. Thus the cam member 102 may be operatively positioned as shown in FIG. 16, and upon rotation thereof it acts to move the plates laterally with respect to each other.

FIG. 17 shows still another embodiment wherein a slot 107 is formed in the upper plate 60, the slot necessary where the plates are otherwise guided for linear relative movement.

From the above description, it will be apparent that the air flow control valve of the present invention provides a convenient and readily accessible means for accurately controlling the volume of air flowing through each of the filters in a filter bank to thereby insure a uniform, laminar flow through the room. Also, the fact that the air flow control valve of the present invention is mounted downstream and spaced from the filter pack results in a positive pressure within the plenum formed between the filter pack and valve, the pressurized plenum serving to equalize the volume of air flowing outwardly from all portions of the area of the filter. This significant advantage is not achieved in the above described prior art valves which are mounted on the upstream side of the filter.

While the illustrated clean rooms 20 and 80 are of the vertical flow type, it will be appreciated that the present invention is also applicable where the filter bank comprises a vertical wall and the air flows horizontally through the room.

In the drawings and specification, there has been set forth a preferred embodiment of the invention, and although specific terms are employed, they are used in a generic and descriptive sense only and not for purposes of limitation.

That which is claimed is:

1. A clean room having provision for supplying a substantially uniformly distributed flow of filtered air therethrough and comprising an enclosure including a top wall, a bottom wall, and bounding side walls, a filter bank disposed within said enclosure and positioned parallel to and spaced from one of said top and side walls to define an upstream side facing said one wall and a downstream side facing the opposite direction, said filter bank having an area substantially coextensive with the area of said one wall and comprising a supporting latticework defining a plurality of rectangular open areas, a plurality of high efficiency air filters positioned on said latticework with one of said filters covering each of said open areas, and independently operable valve means coextensively extending across the downstream side of each of said air filters for selectively and accurately regulating the volume of air flowing therethrough, each of said valve means comprising a. a first substantially flat plate having myriad relatively small, regularly spaced apertures extending therethough, and with said apertures being positioned to overlie substantially the entire area of said plate, said first plate having a rectangular outline closely conforming to the rectangular outline of the associated open area in said latticework, b. a second substantially flat plate of a size and outline substantially corresponding to that of said first plate and having myriad apertures extending therethrough, said apertures in said second plate being of a size and spacing corresponding to the sized and spacing of the apertures in said first plate, c. means for mounting said first and second plates in an overlying, face to face relationship, d. means accessible from said downstream side of said filter bank for selectively translating one of said plates laterally with respect to the other plate such that the apertures in said plates may be selectively brought into alignment to effect opening of the valve means and brought out of alignment to effect closing of the valve means, and e. a film of highly viscous, non-evaporating fluid interposed between the full area of the opposing faces of said plates and serving to prevent the flow of air laterally therebetween, and flower means for introducing air under pressure to the upstream side of each of said air fliters such that the air flows through said filters and valve means and into the clean room.

2. The clean room as defined in claim 1 wherein said means for introducing air under pressure to said filters comprises a hood sealably enclosing the upstram side of each of said filters, duct means communicating with each of said hoods, and air blower means for introducing air under pressure into said duct means.

3. A clean room having provision for supplying a substantially uniformly distributed flow of filtered air therethrough and comprising an enclosure including a top wall, a bottom wall, and bounding side walls, a filter bank disposed within said enclosure and postioned parallel to and spaced from said top wall, said filter bank having an area subtantially coextensive with the area of said top wall to define an open plenum therebetween and comprising a horizontally disposed supporting latticework defining a plurality of rectangular open areas, a plurality of high efficiency air filters positioned on said latticework with one of said filters covering each of said open areas, means for sealing said latticework to said bounding side walls and said filters, and independently operable valve means coextensively extending across the lower side of each of said air filters for selectively and accurately regulating the volume of air flowing therethrough, each of said valve means comprising a. a first substantially flat plate having myriad relatively small, regularly spaced apertures extending therethrough, and with said apertures being positoned to overlie substantially the entire area of said plate, said first plate having a rectangular outline closely conforming to the rectangular outline of the associated open area in said latticework, b. a second substantially flat plate of a size and outline substantially corresponding to that of said first plate and having myriad apertures extending therethrough, said apertures in said second plate being of a size and spacing corresponding to the size and spacing of the apertures in said first plate, c. means for mounting said first and second plate in an overlying, face to face relationship, d. means accessible from below said filter bank for selectively translating one of said plates laterally with respect to the other plate such that the apertures in said plates may be selectively brought into alignment to effect opening of the valve means and brought out of alignment to effect closing of the valve means, and e. a highly viscous, non-evaporating fluid interposed between the opposing faces of said first and second plates, said fluid having a consistency similar to that of household petrolatum and being adapted to prevent the flow of air laterally between said plates to thereby assure that the air flow through all portions of the overlying plates may be accurately controlled by the relative positioning of the apertures therein, and means for introducing air under pressure into said open plenum such that the air flows downwardly through said filters and valve means and into the clean room.

4. A high efficiency air filtration apparatus having provision for selectively and accurately regulating the volume of air flowing therethrough and such that the volume of air flowing through all portions of the area thereof is substantially uniform, and comprising an enclosure, a high efficiency air filter sealably disposed within said enclosure to define an upstream face and a downstream face, valve means transversely and coextensively extending across the downstream face of said air filter for selectively and accurately regulating the volume of air flowing therethrough, said valve means being spaced from the downstream face of the filter to define a plenum therebetween and comprising a. a first substantially flat plate having myraid relatively small, regularly spaced apertures extending therethrough, and with said apertures being positioned to overlie substantially the entire area of said plate, said first plate having a peripheral outline closely conforming to the peripheral outline of said filter, b. a second substantially flat plate of a size and outline substantially corresponding to that of said first plate and having myriad apertures extending therethrough, said apertures in said second plate being of a size and spacing corresponding to the size and spacing of the apertures in said first plate, c. means for mounting said first and second plates in an overlying, face to face relationship, d. means accessible from the downstream side of said filter for selectively translating one of said plates laterally with respect to the other plate such that the apertures in said plates may be selectively brought into alignment to effect opening of the valve means and brought out of alignment to effect closing of the valve means, and e. a film of non-evaporating fluid interposed between the full area of the opposing faces of said plates and serving to prevent the flow of air laterally therebetween, and flower means for introducing air under pressure into the enclosure on the upstream side of said air filter such that the air flows through said filter and valve means.

5. The high efficiency air filtration apparatus as defined in claim 4 wherein the area occupied by said apertures in each of said first and second plates comprises at least about 30 % of the total area of said plates.

6. The high efficiency air filtration apparatus as defined in claim 4 wherein said means for selectively translating said plate comprises means defining a circular first opening positioned through the central portion of one of said plates, means defining a second opening positioned through the central portion of the other of said plates, said second opening having an overall size somewhat smaller than that of said first opening, and a cam member through said first and second openings and including a cylindrical portion closely received within said first opening of said one plate, and an end portion closely received within said second opening of said other plate, said end portion being axially offset from the axis defined by said cylindrical portion whereby rotation of said cam member causes said end portion to act upon the boundary of said second opening and thereby move the plates laterally with respect to each other.

7. The high efficiency air filtration apparatus as defined in claim 4 wherein said means for selectively translating said plates laterally with respect to each other includes means for limiting the relative movement along a linear path of travel.

8. A high efficiency air filtration apparatus as defined in claim 4 wherein said fluid is highly viscous and has a consistency substantially the same as that of household petrolatum.

9. The high efficiency air filtration apparatus as defined in claim 8 wherein said fluid has a viscosity between about 70,000 to 150,000 centipoise at room temperature.

10. The high efficiency air filtration apparatus as defined in claim 4 wherein said filter comprises a frame of rectangular cross-sectional configuration to define a rectangular air flow opening, and a filter pack sealably disposed within said frame and filling said air flow opening and comprising a sheet of filtering media folded in accordion fashion and with the folds thereof lying substantially parallel to the direction of air flow through the filter.

11. The high efficiency air filtration apparatus as defined in claim 10 wherein said means for mounting said first and second plates in face to face relationship comprises a channel of U-shaped cross-sectional configuration receiving the peripheral edge portion of each plate therewithin.

12. The high efficiency air filtration apparatus as defined in claim 11 wherein said U-shaped channel is secured to the downstream end of said frame.

* * * * *

UNITED STATES PATENT AND TRADEMARK OFFICE

CERTIFICATE OF CORRECTION

PATENT NO. : 3,986,850

DATED : October 19, 1976

INVENTOR(S) : David E. Wilcox

It is certified that error appears in the above-identified patent and that said Letters Patent are hereby corrected as shown below:

On the title page, after "References Cited", add
--2,065,726 12/1936 Nordstrom 137/246.12--

Column 7, line 39, change "plate" to --plates--;
Column 7, line 55, after "offset" insert --from the axis defined by the cylindrical portion and adapted to be received--;
Column 7, line 61, after "slot",second occurence,insert --being--
Column 8, line 67, change "flower" to --blower--.
Column 9, line 7, change "upstram" to --upstream--;
Column 9, line 50, change "plate" to --plates--.
Column 10, line 43, change "flower" to --blower--;
Column 10, line 61, after "member", insert --extending--.

Signed and Sealed this

First Day of March 1977

[SEAL]

*Attest:*

RUTH C. MASON
*Attesting Officer*

C. MARSHALL DANN
*Commissioner of Patents and Trademarks*